US009564982B2

(12) United States Patent
Ito

(10) Patent No.: US 9,564,982 B2
(45) Date of Patent: Feb. 7, 2017

(54) AUDIO CONTROL CONSOLE

(71) Applicant: Yamaha Corporation, Hamamatsu-shi, Shizuoka-ken (JP)

(72) Inventor: Masafumi Ito, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 82 days.

(21) Appl. No.: 14/510,434

(22) Filed: Oct. 9, 2014

(65) Prior Publication Data

US 2015/0104042 A1 Apr. 16, 2015

(30) Foreign Application Priority Data

Oct. 10, 2013 (JP) ..... 2013-212815

(51) Int. Cl.
*H04H 60/04* (2008.01)
*H04R 3/00* (2006.01)

(52) U.S. Cl.
CPC ..... *H04H 60/04* (2013.01); *H04R 3/00* (2013.01); *H04R 2420/01* (2013.01)

(58) Field of Classification Search
None
See application file for complete search history.

(56) References Cited

U.S. PATENT DOCUMENTS 6,438,241 B1 * 8/2002 Silfvast ..... H04H 60/04 307/112
D554,623 S * 11/2007 Wussler ..... D14/217
7,616,770 B2 * 11/2009 Haba ..... G10H 1/32 248/177.1
D647,880 S * 11/2011 Huber ..... D14/217
2008/0165989 A1 * 7/2008 Seil ..... H04H 60/04 381/119
2013/0182872 A1 * 7/2013 Olswang ..... G06F 1/1632 381/119
2013/0201398 A1 * 8/2013 Radin ..... H03G 5/005 348/552

(Continued)

FOREIGN PATENT DOCUMENTS

JP 5-123224 A 5/1993
JP 2006262280 A * 9/2006

(Continued)

OTHER PUBLICATIONS

Machine Translation of Nakazawa et al., JP 2006-262280 A, published Sep. 28, 2006.*

*Primary Examiner* — Peter Vincent Agustin
(74) *Attorney, Agent, or Firm* — Crowell & Moring LLP

(57) ABSTRACT

An audio control console includes a housing. The housing includes: an operating board provided with a plurality of rows of a plurality of channel strips each including a plurality of operating members each for controlling a value of a parameter of an audio signal processing in a signal processing channel; a support board comprising a flat blank region allowing an object to be placed thereon; and a stepped surface connecting the operating board and the support board to each other. The stepped surface connects the operating board and the support board to each other such that a height position of the support board is above a height position of the operating board. The blank region is inclined downward toward the stepped surface.

12 Claims, 4 Drawing Sheets

(56) References Cited

U.S. PATENT DOCUMENTS

| | | | | |
|---|---|---|---|---|
| 2014/0112499 | A1* | 4/2014 | Lintz | H04R 3/00 381/119 |
| 2015/0104042 | A1* | 4/2015 | Ito | H04H 60/04 381/119 |

FOREIGN PATENT DOCUMENTS

| | | | |
|---|---|---|---|
| JP | 2010-171227 | A | 8/2010 |
| JP | 2010-226261 | A | 10/2010 |
| JP | 4992483 | B2 | 8/2012 |

* cited by examiner

AUDIO CONTROL CONSOLE

CROSS REFERENCE TO RELATED APPLICATION

The present application claims priority from Japanese Patent Application No. 2013-212815, which was filed on Oct. 10, 2013, the disclosure of which is herein incorporated by reference in its entirety.

BACKGROUND

Technical Field

The present invention relates to an audio control console such as a mixing console.

Description of the Related Art

There has been known an audio controller such as a mixer which blends together multiple sound sources or voice signals to produce combined output signals. Such an audio controller includes a plurality of channel strips provided with various kinds of controls (i.e., operating members) to control sound volumes and sound qualities of the respective sound sources that have input to signal processing channels.

In recent years, digital mixers which convert input voice signals to digital signals to process the voice signals have achieved widespread use in addition to analog mixers using analog processing to process input voice signals. Any of the digital mixers and the analog mixers executes signal processing in each channel such as gain control, equalization, panning control, and control for main sound volume (a fader). In the analog mixers, a plurality of channel strips respectively corresponding to signal processing channels are provided on an operation panel, and each of the channel strips is provided with a multiplicity of controls for individually controlling parameters for signal processings, resulting in increase in size of the operation panel. In the digital mixers, each channel strip can be assigned to a desired signal processing channels, and each control can be assigned to a desired one of parameters for the signal processings, resulting in reduced number of channel strips and controls provided on the operation panel, leading to a reduced-size housing. A mixer of a console type having a plurality of channel strips on an upper surface portion of a housing is called a mixing console, for example.

A digital mixer (i.e., a digital mixing console) is typically provided with a display on a main body for various kinds of settings. In such a digital mixer, signal processings such as controls of sound quality and sound volume, delay, and reverb are achieved by software. Also, larger packing densities, higher speed, and the like of semiconductor (such as a CPU, a DSP, and a memory) can greatly reduce the area of circuit components, printed circuit boards, and so on disposed in the digital mixer when compared with analog mixers, allowing greater functionality and less space.

For such mixing consoles, for example, various constructions have been proposed such as (i) a construction disclosed in Patent Document 1 (Japanese Patent Application Publication No. 2010-171227) in which devices including a speaker, a keyboard, and a mouse can be placed on an upper portion of a housing and (ii) a construction disclosed in Patent Document 2 (Japanese Patent Application Publication No. 2010-226261) in which even though the mixing console has a multiplicity of channels, the console is constructed so as to have a relatively small width and accordingly requires less space. Also, Patent Document 3 (Japanese Patent Application Publication No. 05-123224) discloses a construction in which a table for supporting a script is provided on an operating board of a mixing console.

SUMMARY

In analog mixing consoles, since each of controls (i.e., operating members) is assigned with a single function, the controls are provided on channel strips so as to be arranged on generally the entire surface of an operation panel. In digital mixing consoles, on the other hand, since the number of controls can be reduced, even in a construction in which a display for various settings is provided on an operation panel, a blank region not provided with any components can be provided on the operation panel or the like.

Also, in recent years, tablet computers allowing touch input on liquid crystal screens with finger or fingers of an operator have been widely used, and mixers having a function in which such a tablet computer serves as both of a sub-display and a remote controller have been developed, for example. Accordingly, it is assumed that the operator operates the mixer, with the tablet computer being placed near an operation portion of the mixer.

In this case, a stay separated from a main body of the mixer can be provided as disclosed in Patent Document 3, but this construction requires increased number of components and increased steps of processing and assembling materials, leading to increased cost.

This invention has been developed to provide an audio control console capable of stably supporting a device such as a tablet computer without increased cost.

The present invention provides an audio control console including a housing. The housing includes: an operating board provided with a plurality of rows of a plurality of channel strips each including a plurality of operating members each for controlling a value of a parameter of an audio signal processing in a signal processing channel; a support board having a flat blank region allowing an object to be placed thereon; and a stepped surface connecting the operating board and the support board to each other. The stepped surface connects the operating board and the support board to each other such that a height position of the support board is above a height position of the operating board. The blank region is inclined downward toward the stepped surface.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Figure 1:
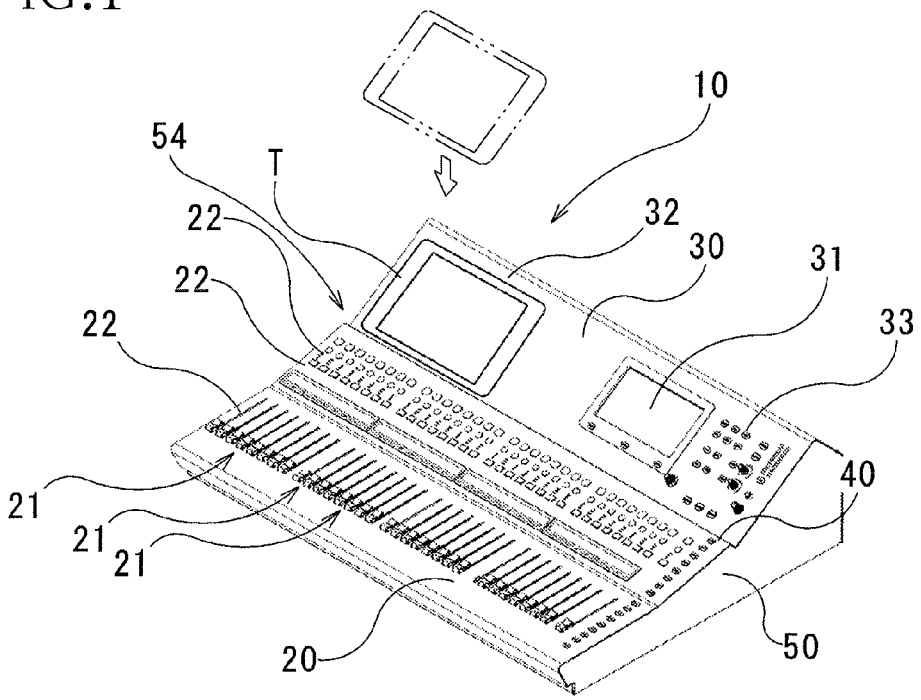
FIG. 1 is a perspective view of an audio control console according to one embodiment of the present invention.

Hereinafter, there will be described an audio control console according to one embodiment of the present invention. As illustrated in FIG. 1, an audio control console 10 is a digital mixer and includes a housing. A housing upper surface portion 52 includes: an operating board 20 provided with a plurality channel strips 21 each including a plurality of controls 22 as one example of operating members for controlling or adjusting values of parameters for a voice signal processing on a corresponding one of input channels; a support board 30 having a flat blank region 32 on which an object such as a tablet computer can be placed; and a stepped surface 40 connecting the operating board 20 and the support board 30 to each other. The housing upper surface portion 52 has a stepped shape and is mounted on a housing lower portion 50. In this housing upper surface portion 52, the height level of the support board 30 is higher than that of the operating board 20, with the stepped surface 40 interposed therebetween. Also, the stepped surface 40 connects an upper edge portion of the operating board 20 and a lower edge portion of the support board 30 to each other such that a height position of the upper edge portion of the operating board 20 is above a height position of the lower edge portion of the support board 30. The blank region 32 is inclined such that a portion of the blank region 32 nearer to the stepped surface 40 is located lower in height level than a portion of the blank region 32 farther from the stepped surface 40. In the present embodiment, the support board 30 is a display board 30 including: a display 31 as one example of a display device capable of displaying information; and an operating region 33 on which various kinds of controls or operating members such as a master volume are provided.

Figure 2:
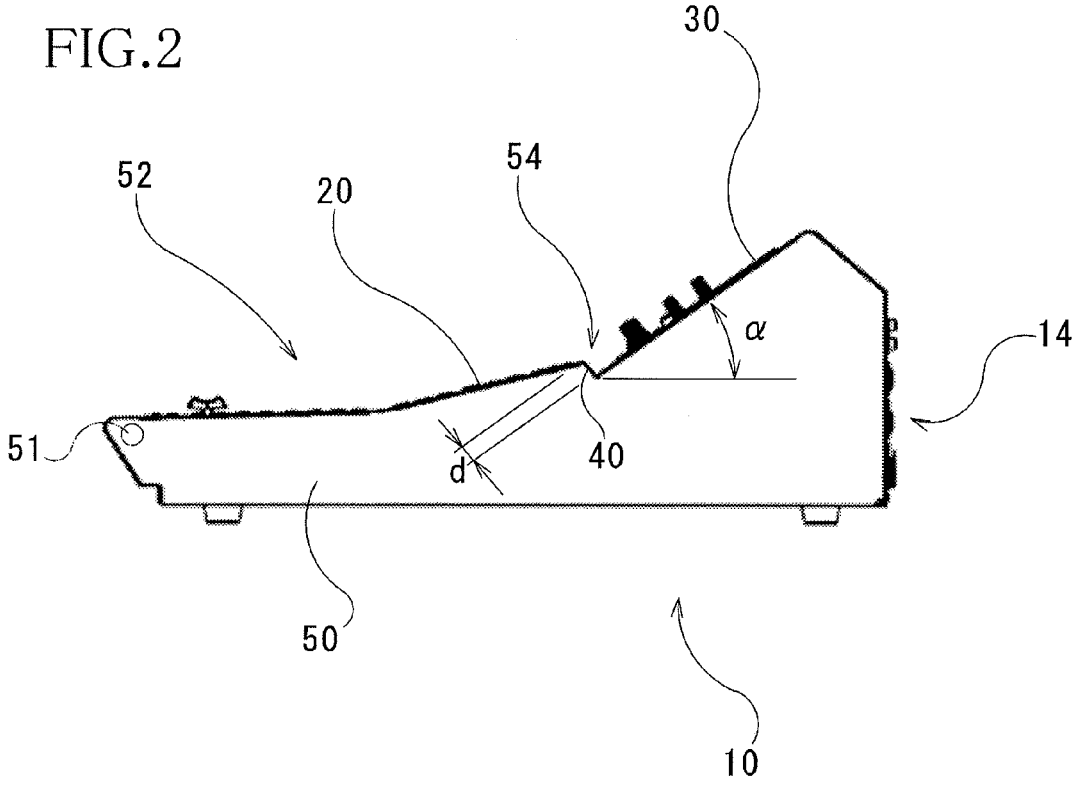
FIG. 2 is a side view of the audio control console illustrated in FIG. 1.

On the housing upper surface portion 52 of the audio control console 10, as illustrated in FIG. 2, the operating board 20 is provided generally horizontally or so as to be slightly inclined such that a portion of the operating board 20 nearer to the stepped surface 40 is higher in height level than a portion of the operating board 20 farther from the stepped surface 40. For example, the operating board 20 is inclined at an angle ranging from 0° to 40° with respect to the horizontal plane. It is noted that the angle of inclination of the operating board 20 with respect to the horizontal plane is smaller than or equal to that of the display board 30.

A surface of the display 31 of the display board 30 is inclined with respect to the horizontal plane such that a portion thereof nearer to the stepped surface 40 is lower in height position than a portion thereof farther from the stepped surface 40. For example, the surface of the display 31 is inclined at an angle ranging from 15° to 40° indicated by a in FIG. 2. The difference in height between the operating board 20 and the display board 30 is determined such that the width d of the stepped surface 40 ranges from 8 mm to 16 mm, for example.

In other words, on the housing upper surface portion 52, the stepped surface 40 inclined obliquely downward from an upper edge of the operating board 20 so as to be connected to the display board 30 is provided on a lower edge portion of the display board 30 inclined obliquely upward from an area adjacent to one edge of the operating board 20. With this construction, when an object is placed on the display board 30, the object is supported on the stepped surface 40. It is noted that, as illustrated in FIG. 2, the distance d between (i) a front edge portion of the stepped surface 40 which is connected to the upper edge portion of the operating board 20 and (ii) a rear edge of the stepped surface 40 which is connected to the lower edge portion of the display board 30, i.e., the distance d between the operating board 20 and the display board 30 at the stepped surface 40 ranges between 8 mm and 16 mm.

Figure 3:
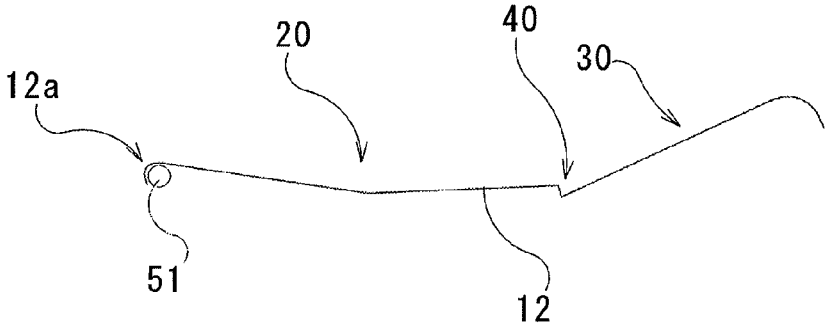
FIG. 3 is a schematic view illustrating one example of construction of an operating board, a stepped surface, and a display board of the audio control console according to the present invention.

As illustrated in FIG. 3, the operating board 20, the display board 30, and the stepped surface 40 are formed by bending a single metal plate 12 and accordingly continuous to each other. In the bending of the metal plate 12, a straight mountain fold is made at a boundary between the operating board 20 and the stepped surface 40, and a valley fold is made at a boundary between the stepped surface 40 and the display board 30.

Figure 4:
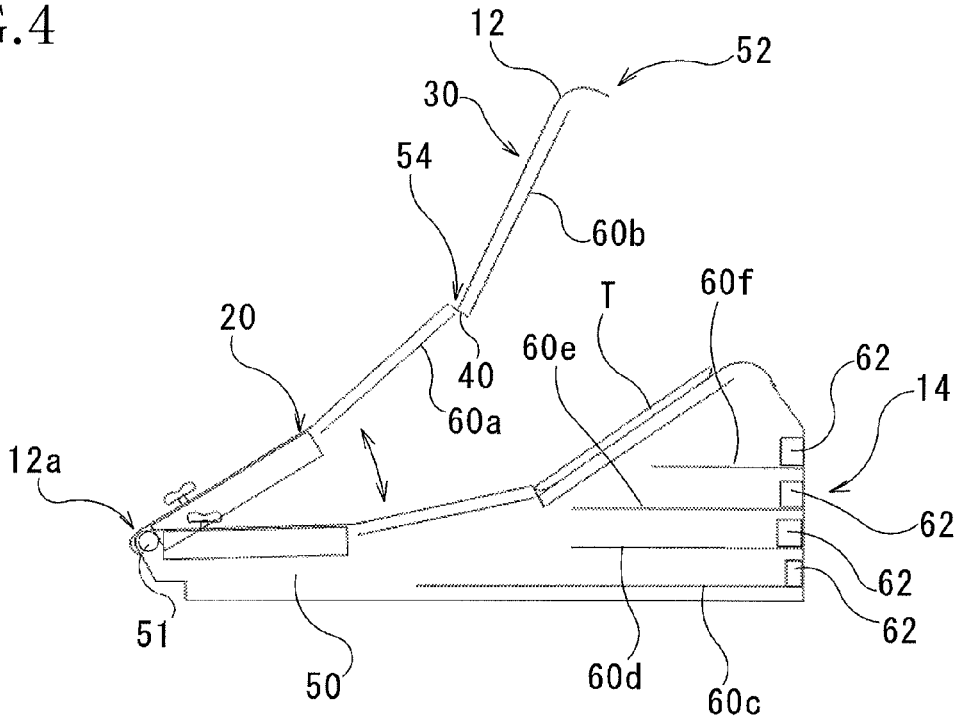
FIG. 4 is a schematic view illustrating a construction for mounting a housing upper surface portion of the audio control console according to the present invention.

As illustrated in FIGS. 2-4, the metal plate 12 is bent so as to have a U-shape in cross section at an edge portion 12*a* of the metal plate 12 and the operating board 20. This edge portion 12*a* is engaged with a hinge 51 provided on the housing lower portion 50, allowing pivotal movement of the metal plate 12 with respect to the housing lower portion 50. This construction of the audio control console 10 enables easy opening and closing of the housing upper surface portion 52 with respect to the housing lower portion 50, facilitating a maintenance operation in the audio control console 10.

On a back side of the housing upper surface portion 52, a circuit board 60*a* mounted on a back surface of the operating board 20 and a circuit board 60*b* mounted on a back surface of the display board 30 are connected to each other, with the stepped surface 40 interposed therebetween. In the housing lower portion 50, circuit boards 60*c*, 60*d*, 60*e*, 60*f* respectively provided with input/output connectors 62 provided on a back surface 14 of the audio control console 10 are mounted so as to be stacked on each other in the up and down direction. These circuit boards 60*c*-60*f* are arranged in an efficient configuration in a relatively tall space partly defined by the display board 30 inclined with respect to the horizontal plane.

In the audio control console 10, a plurality of voice signals are input to a plurality of signal processing channels, and the audio control console 10 sums voice signals whose characteristics such as a signal level are controlled by signal processings in signal processing channels, to produce combined output signals. Parameters for each of the signal processings in the signal processing channels (such as gain control, equalization, panning control, and control for control for main sound volume) are controlled by operations of the controls 22 provided on the channel strip 21 to which the signal processing channel is assigned. Each of the channel strips 21 is elongated in the front and rear direction, and the channel strips 21 are arranged on the operating board 20 in the right and left direction.

Examples of the controls 22 include knobs such as rotary volumes and rotary encoders, slide controls such as fader controls, and switches. Each of the channel strips 21 is provided with a set of various types of the controls 22 and indicators such as an LED and an LCD as needed. The controls 22 are exposed to an upper side of the metal plate 12 through openings, not shown, such as small openings and slits formed in the metal plate 12.

In the digital mixer, each of the controls 22 is assigned with a desired parameter of the parameters for the signal processing, allowing an operator to control the parameters for the signal processing with a small number of the controls 22. For example, the digital mixer is configured such that a plurality of layers each having its own channels equal in number to the channel strips 21 are defined in advance and such that when one of the layers is chosen with a layer switch provided on the operating region 33, the channels of the chosen layer are assigned to the plurality of channel strips 21. The controls 22 of each of the channel strips are assigned respectively with desired parameters of the parameters for the signal processings. These parameters of the channel are displayed on the display 31 or indicators of the channel strips.

That is, in the digital mixer, the operator can change channels assigned to one channel strip 21 by, e.g., switching a layer, and accordingly the operator can use controls 22 of the one channel strip 21 to control parameters of a plurality of the channels. However, the number of parameters for signal processings in each channel is normally larger than the number of controls 22 of the one channel strip 21. Accordingly, a typical digital mixer is configured such that when one of the channels is chosen by an operator, a plurality of parameters relating to the chosen channel are displayed on the display 31, allowing the operator to intensively control the parameters with, e.g., the controls provided on the operating region 33 (noted that this function hereinafter may be referred to as "chosen-channel edit function").

In the audio control console 10 including the display 31 for displaying information relating to various settings, the display 31 is preferably disposed near the channel strips 21 for operability and viewability. Thus, the display 31 is disposed on the display board 30 provided adjacent to the operating board 20, and the display 31 is inclined at a predetermined angle for better viewability for an operator operating the controls 22 provided on the operating board 20.

Information displayed on the display 31 and operations on the display 31 by the operator in the chosen-channel edit function can be set as needed. The audio control console 10 according to the present embodiment has a relatively small area for the display 31 and the operating region 33, thereby additionally forming the flat blank region 32 on which no display devices or no controls are provided.

This audio control console 10 has a function in which the audio control console 10 can be remotely controlled via a network from an external device (i.e., a remote control device). Examples of the remote control device include a laptop computer and a tablet computer capable of executing predetermined software such as an application program for remote control. Various kinds of networks including wireless connections and wired connections may be used to connect the audio control console 10 and the remote control device to each other. In the remote control device, the information displayed on the display 31 in the chosen-channel edit function and GUI control components corresponding to the controls or operating members provided on the operating region 33 can be used to achieve a function corresponding to the chosen-channel edit function, for example. Furthermore, various settings and the like can be displayed on a display of the remote control device in addition to the display 31 to expand a display function and an edit function. In a case where a remote control device (in the form of a tablet computer T in FIG. 1) is placed on the blank region 32 of the display board 30, for example, an operator can operate the controls 22 provided on the channel strips 21 while viewing the display provided on the remote control device. Also, the operator can use software installed in the remote control device, to control or edit individual parameters of the audio control console 10.

A support shelf 54 recessed downward is defined by the display board 30 on which the blank region 32 is formed and the stepped surface 40 connected to the lower portion of the display board 30. Since the blank region 32 is inclined at an angle ranging from 15° to 40° with respect to the horizontal plane such that the portion of the blank region 32 nearer to the stepped surface 40 is located lower in height level than the portion of the blank region 32 farther from the stepped surface 40, the tablet computer T placed on the blank region 32 is held in contact with the stepped surface 40 along the inclination and stably supported. It is noted that this support shelf 54 can support not only the remote control devices such as the tablet computer T but also other objects such as a script and a microphone as needed.

A display screen of the remote control device, e.g., the tablet computer T placed on the blank region 32 is inclined at an angle ranging from 15° to 40° with respect to the horizontal plane like the blank region 32, offering better viewability for the operator. In a case where the remote control device is a device such as the tablet computer T having a touch panel as a display screen and a laptop computer having a keyboard, an operating surface of the remote control device is inclined at an angle substantially ranging from 15° to 40° with respect to the horizontal plane like the blank region 32, offering better operability for the operator.

In the audio control console 10 described above, the stepped surface 40 is provided between the operating board 20 and the display board 30, which forms the support shelf 54 capable of stably holding or supporting the remote control device such as a tablet computer and a laptop computer. The blank region 32 of the display board 30 which is continuous to the support shelf 54 is inclined at an angle ranging from 15° to 40° with respect to the horizontal plane, providing better viewability and operability of the remote control device. Excessively small inclination angle may deteriorates the viewability and the operability for the operator of the remote control device placed on the blank region 32, and excessively large inclination angle may make it difficult to stably support the remote control device. While the inclination angle of the blank region 32 ranges from 15° to 40° with respect to the horizontal plane in the audio control console 10 according to the present embodiment, the inclination angle is preferably determined in consideration of the size and the inclination angle of the audio control console 10 and the operating board 20 and the display function and the edit function achieved using the remote control device as a whole, for example.

The width d of the stepped surface 40 ranges from 8 mm to 16 mm, providing good continuity between the operating board 20 and the display board 30 and good continuity between the tablet computer T (i.e., the remote control device) placed on the blank region 32 and the operating board 20. Excessively small width d may make it difficult to stably support the remote control device, and excessively large width d may deteriorate the continuity between the operating board 20 and the display 31 and the continuity between the tablet computer T (i.e., the remote control device) and the operating board 20, which may deteriorate the viewability and the operability. While this width d of the stepped surface 40 ranges from 8 mm to 16 mm in the audio control console 10 according to the present embodiment, the difference in height is preferably determined in consideration of a shape of the remote control device assumed to be placed (e.g., a width and a thickness of a portion of the remote control device which is to be held in contact with the stepped surface 40).

The stepped surface 40 can be formed by a relatively simple processing of bending the single metal plate 12 linearly, preventing increase in cost due to increase in the number of components and/or processing steps.

Figure 5:
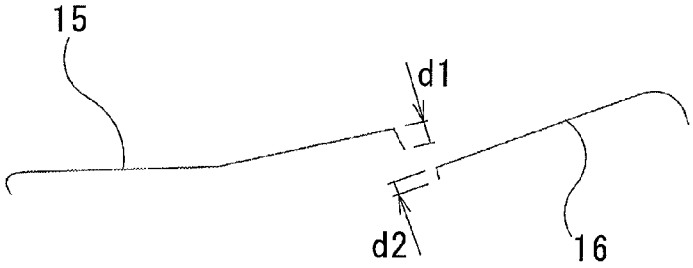
FIG. 5 is a schematic view illustrating one example of construction of the operating board, the stepped surface, and the display board of the audio control console according to the present invention.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. As illustrated in FIG. 5, for example, the audio control console may be configured such that the operating board 20 is constituted by a first metal plate 15, the display board 30 is constituted by a second metal plate 16, and the first metal plate 15 and the second metal plate 16 are connected to each other so as to form the stepped surface 40. Since the operating board 20 and the display board 30 are constituted by different elements, in a case where the first metal plate 15 and the second metal plate 16 are painted in different colors, for example, the audio control console can have two-tone coloring at lower cost.

In this construction, a mountain fold is made at a rear edge of the first metal plate 15 (i.e., a right edge in FIG. 5) at a predetermined mountain fold width d1, and a mountain fold is made at a front edge of the second metal plate 16 (i.e., a left edge in FIG. 5) at a predetermined mountain fold width d2 (smaller than the mountain fold width d1). The first metal plate 15 and the second metal plate 16 are fixed to each other by, e.g., screws or welding, in a state in which the edges of the first metal plate 15 and the second metal plate 16 are aligned to each other, which forms the stepped surface 40 having a height related to a difference between the mountain fold widths d1 and d2.

Figure 6:
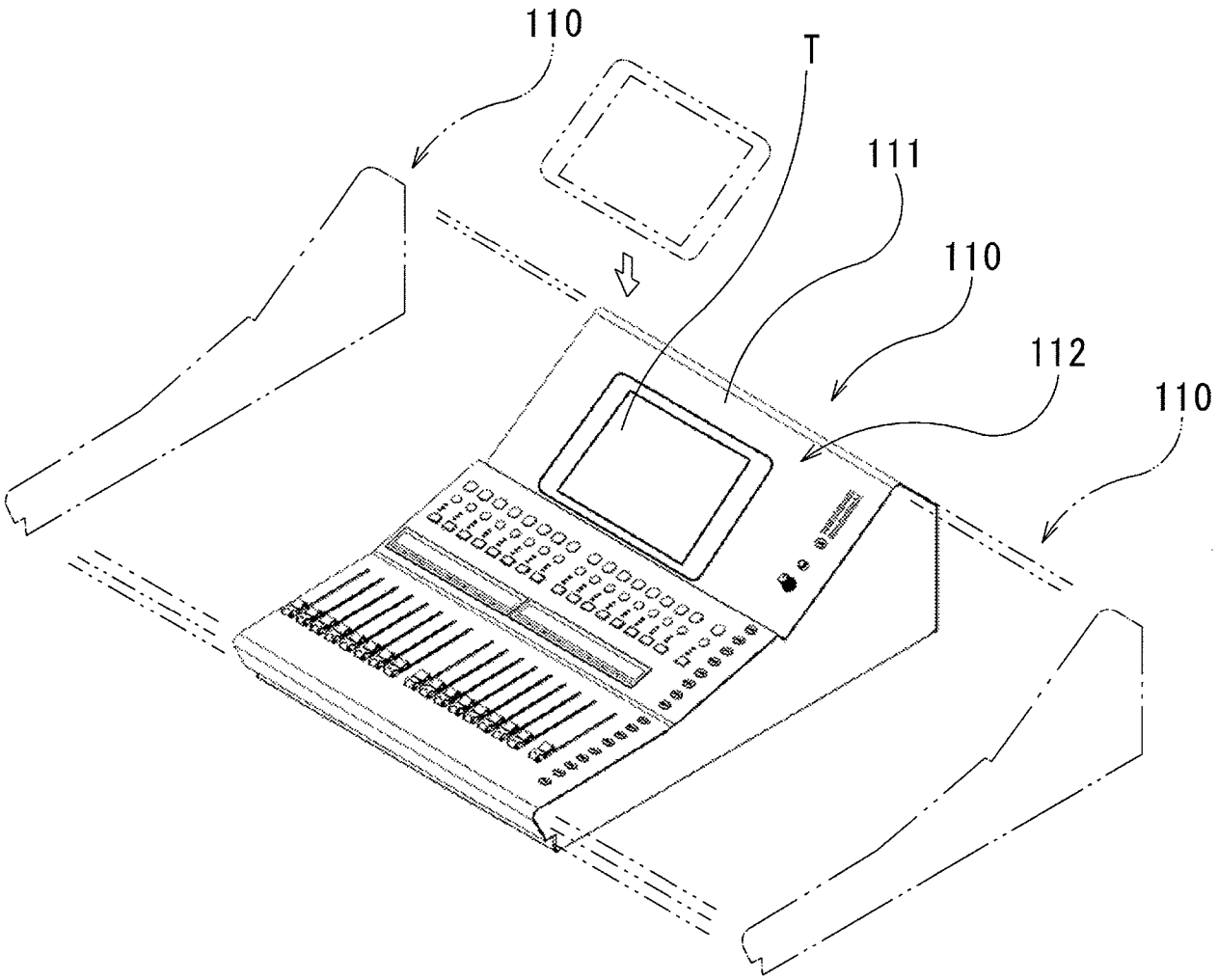
FIG. 6 is a perspective view of an audio control console according to a first alternative embodiment of the present invention.
Figure 7:
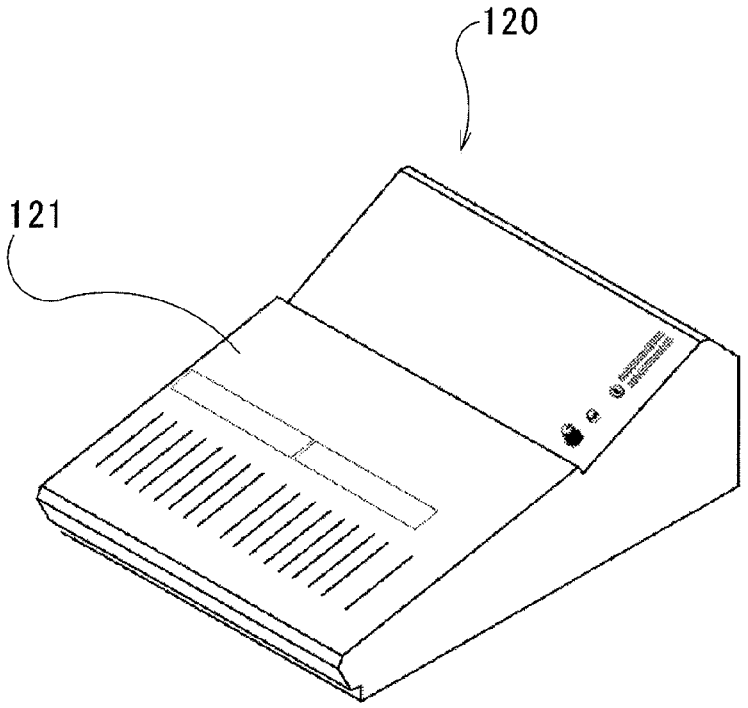
FIG. 7 is a perspective view of an audio control console according to a second alternative embodiment of the present invention.
Figure 8:
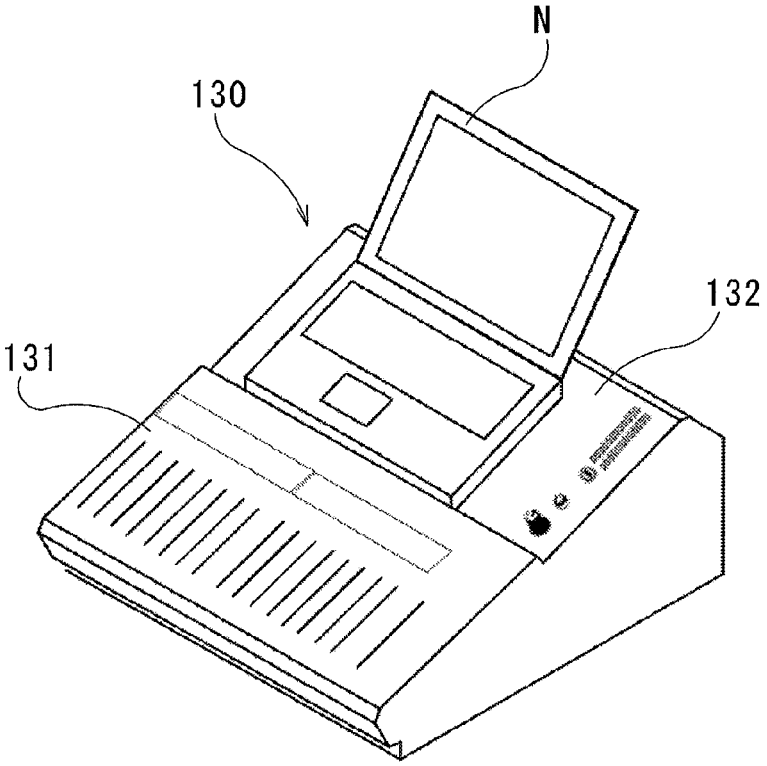
FIG. 8 is a perspective view of an audio control console according to a third alternative embodiment of the present invention.

FIGS. 6-8 illustrate alternative embodiments of the present invention. The present invention is applicable to an audio control console not provided with a fixed display on a support board. An audio control console 110 according to the first alternative embodiment illustrated in FIG. 6 does not have a fixed display on a support board 111 and has a reduced width in the right and left direction. Accordingly, a plurality of the audio control consoles 110 can be arranged in the right and left direction by cascade connection (see Japanese Patent No. 4992483). In this construction, the area of a blank region 112 can be increased by an amount corresponding to the number of the arranged audio control consoles 110, allowing the larger number of remote control devices and scripts to be placed and arranged, for example.

An audio control console 120 according to the second alternative embodiment illustrated in FIG. 7 includes a main body having increased thickness. This construction increases a space formed under an operating board 121, resulting in increase in the area of space for storing circuit boards.

An audio control console 130 according to the third alternative embodiment illustrated in FIG. 8 includes an operating board 131 having a smaller depth, whereby a support board 132 is located near an operator. Accordingly, in a case where a remote control device (in the form of a clamshell laptop computer N in FIG. 8) is placed on the support board 132, for example, the operator is not far from a display screen.

The audio control console according to the above-described embodiment may be configured to process voice signals by itself and may be configured to have only a user interface function for various operations (in other words, the audio control console includes only devices such as the controls 22, the display 31, and the operating region 33), and a signal processing is executed by an external device called "engine". In this configuration, the audio control console and the engine are connected to each other over a network, and the audio control console (and the remote control device) remotely controls the engine.

The present invention is applicable to a physical controller for application programs known as a digital audio workstation (DAW) which operates in, e.g., a personal computer (PC), and the PC in which the DAW operates may be a remote control device to be placed on the support board of the audio control console. In this case, the PC or the remote control device executing the DAW corresponds to the above-described engine.

What is claimed is:

1. An audio control console comprising a housing, the housing comprising:

an operating board comprising a first flat surface on which a plurality of channel strips are arranged, each of the channel strips comprising a plurality of operating members each for controlling a value of a parameter of an audio signal processing in a signal processing channel;

a support board comprising a second flat surface on which a flat blank region allowing an object to be placed thereon is formed; and a stepped surface connecting the operating board and the support board to each other, the stepped surface connecting the operating board and the support board to each other such that a height position of the support board is above a height position of the operating board, the second flat surface being inclined downward toward the stepped surface, and an angle of inclination of the second flat surface ranges between fifteen degrees and forty degrees with respect to a support surface on which the audio control console is placed, wherein a distance between the operating board and the support board at the stepped surface ranges between 8 mm and 16 mm.

2. The audio control console according to claim 1, wherein the stepped surface connects an upper edge portion of the operating board and a lower edge portion of the support board to each other such that a height position of the upper edge portion of the operating board is above a height position of the lower edge portion of the support board.

3. The audio control console according to claim 2, wherein an angle of inclination of the second flat surface with respect to the support surface is greater than an angle of inclination of the first flat surface with respect to the support surface.

4. The audio control console according to claim 1, wherein the support board is a display board comprising a display device capable of displaying information relating to the parameter.

5. The audio control console according to claim 1, wherein the operating board, the support board, and the stepped surface are continuously formed by bending one metal plate.

6. The audio control console according to claim 1, wherein the operating board is constituted by a first metal plate, and the support board is constituted by a second metal plate, and wherein the first metal plate and the second metal plate are connected to each other so as to form the stepped surface.

7. The audio control console according to claim 1, wherein each of the plurality of channel strips is elongated in a first direction, and the plurality of channel strips are arranged in a second direction that is perpendicular to the first direction.

8. The audio control console according to claim 1, wherein a first end of the flat blank region nearer to the stepped surface is located lower than a second end of the flat blank region farther from the stepped surface.

9. The audio control console according to claim 1, wherein the support board and the stepped surface defines a support shelf prepared to place thereon an external device as a laptop computer or a tablet computer.

10. The audio control console according to claim 9, wherein the audio control console is configured to be remotely controlled by the external device.

11. The audio control console according to claim 2, wherein a difference in height between the upper edge portion of the operating board and the lower edge portion of the support board is determined such that a width of the stepped surface ranges between 8 mm and 16 mm.

12. The audio control console according to claim 3, wherein an angle of inclination of the first flat surface with respect to the support surface ranges between zero degree and forty degrees.

* * * * *